United States Patent [19]

Vanderford

[11] 4,055,723

[45] Oct. 25, 1977

[54] HEATER SUPPORT ELEMENT FOR ELECTRIC FURNACE

[75] Inventor: Wallace Snow Vanderford, Kintnersville, Pa.

[73] Assignee: Leeds & Northrup Company, North Wales, Pa.

[21] Appl. No.: 706,654

[22] Filed: July 19, 1976

[51] Int. Cl.[2] ..... H05B 3/34

[52] U.S. Cl. ..... 13/25; 219/537; 339/273 R

[58] Field of Search ..... 13/20, 25; 219/213, 219/541, 542, 545, 546, 549, 536, 537; 339/273 R, 273 F

[56] References Cited

U.S. PATENT DOCUMENTS

| | | | |
|---|---|---|---|
| 3,400,253 | 9/1968 | Marker | 13/25 X |
| 3,525,795 | 8/1970 | Westeren et al. | 13/25 |
| 3,798,417 | 3/1974 | Bittner | 219/542 X |
| 3,866,016 | 2/1975 | Tombu | 219/213 |

*Primary Examiner*—R. N. Envall, Jr.
*Attorney, Agent, or Firm*—Raymond F. MacKay; William G. Miller, Jr.

[57] ABSTRACT

A supporting means for a flexible graphite cloth heating element comprised of a conductive bar having a dovetail shaped slot and a mandrel shaped to fit within the slot and to hold a loop of the graphite cloth heating element therein.

8 Claims, 5 Drawing Figures

HEATER SUPPORT ELEMENT FOR ELECTRIC FURNACE

BACKGROUND OF THE INVENTION

Electric furnaces utilizing flexible graphite cloth material as heaters have been disclosed in the prior art and particularly in U.S. Pat. No. 3,525,795. Heaters constructed of this material are generally useful in furnaces in which a reducing atmosphere or a high vacuum is present. It has heretofore been the practice when using flat graphite heaters to support them within the furnace by means of clamping bars drawn together by bolts with the graphite cloth mechanically secured between the clamping bars. Such arrangements make the installation of new heating units time consuming and difficult by virture of the fact that it is necessary to simultaneously secure the clamping bars and the graphite cloth while tightening the holding bolts.

U.S. Pat. No. 3,525,795 is specifically directed to a tubular graphite cloth heating unit for use in an electric furnace which avoids the disadvantages set forth above with respect to attaching the heater unit to the supports but requires that the heater unit be in a tubular form rather than the more preferred flat cloth configuration. Also the support element for the tubular heater does not lend itself to provide mechanical support for and electrical connection to the heater at locations spaced from the ends of the heater.

SUMMARY OF THE INVENTION

The present invention provides a support and electrical connection element for a flat flexible heating unit that makes the installation of a new or replacement heating unit much easier than prior art devices and permits the location of the support element not only at the ends of the heating unit but also at points intermediate the ends of the unit. It is thus possible to more readily support a heater of considerable length by including one or more support members placed along the heater. It is further possible to have the heating unit arranged in other than a linear configuration such as for example to surround three sides of a work chamber in a furnace by utilizing support elements at the corner locations for the heating unit.

In high vacuum furnaces heat is transferred from the heating units to the work almost exclusively by radiation. Because of the dependence upon radiant energy it is desirable to maximize the surface area of the heater unit facing the work. Some experts consider that for good temperature uniformity in the work being heated in a high vacuum furnace at least fifty percent of the surface area facing the work should be heated. The advantages of a flat graphite cloth heater over a tubular configuration in meeting the above requirement is readily apparent as the flat heater exposes a greater surface area to the work than a tubular heater of the same lineal dimensions.

Accordingly, it is an object of the present invention to provide an electric furnace having an improved mounting element for a flat flexible heating unit to simplify the installation of the heating unit into the furnace and to provide the designer of furnaces with greater flexibility with respect to heater layout and design.

It is another object of the invention to provide a simplified support element in which a bar of conductive material is provided with a longitudinal slot to receive the flexible heater unit.

It is a further object of this invention to provide a dovetailed slot in said bar of material and to use a mandrel of cross-sectional dimension greater than the width of the entrance of the dovetailed slot to provide a mechanical holding action for the heater.

DESCRIPTION OF THE INVENTION

Figure 1:
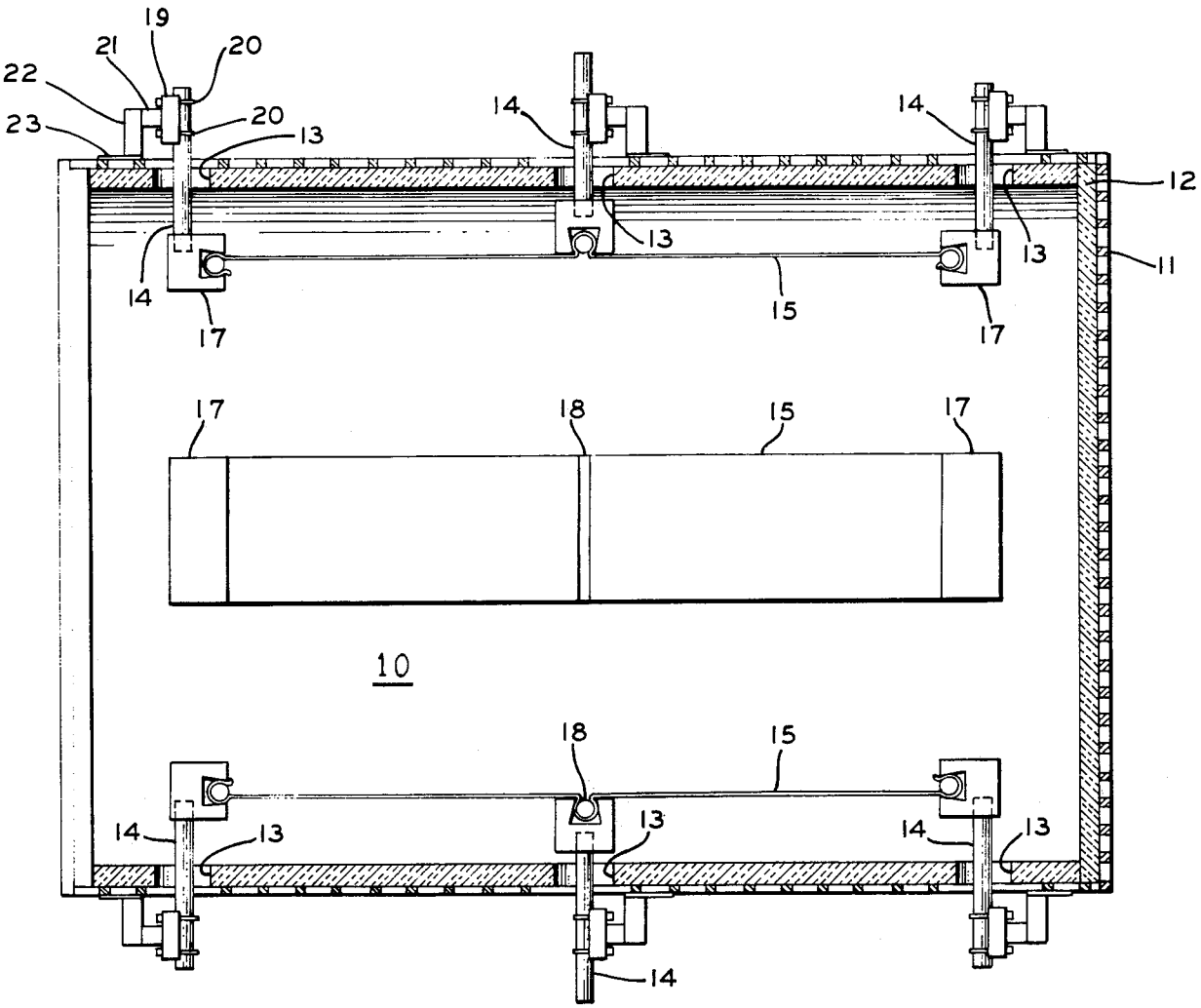
FIG. 1 is a side elevation cross-sectional view of a heating chamber of an electrical furnace showing the novel support elements used for the electrical heating units in the top, bottom and sides of the heating chamber.

FIG. 1 discloses a work heating chamber 10 of the type that would be used in a high vacuum furnace. It is to be understood that the work chamber 10 would be located within a furnace shell, generally water-cooled, to permit the establishment of a vacuum or other inert or reducing atmosphere for the work chamber. As the details of the furnace shell do not constitute any part of this invention and are well known to those skilled in the furnace art, the furnace shell has not been illustrated. The chamber 10 is shown constructed of an outer cage 11 made, for example, of flat expanded metal to provide rigidity to the structure. Alternatively, the cage 11 may be constructed of wire cloth. The left and end of the work chamber 10 is shown as comprising an opening which in normal practice would be closed as by a door, not shown, during the time that work was being heated in the furnace work chamber 10.

Within the cage 11 there is illustrated a lining of heat insulating material 12. This insulating material may be of any suitable type but it has been found that several layers of graphite felt secured by any suitable means to the cage 11 serve as a good insulating material. Alternatively, it is possible to utilize layers of ceramic fiber combined with layers of graphite felt for insulating material 12.

The cage 11 and insulating material 12 are provided with appropriately spaced holes 13 through which extend electrically conducted support rods 14 whereby electric heating units 15 are supported within the work chamber 10.

Figure 2:
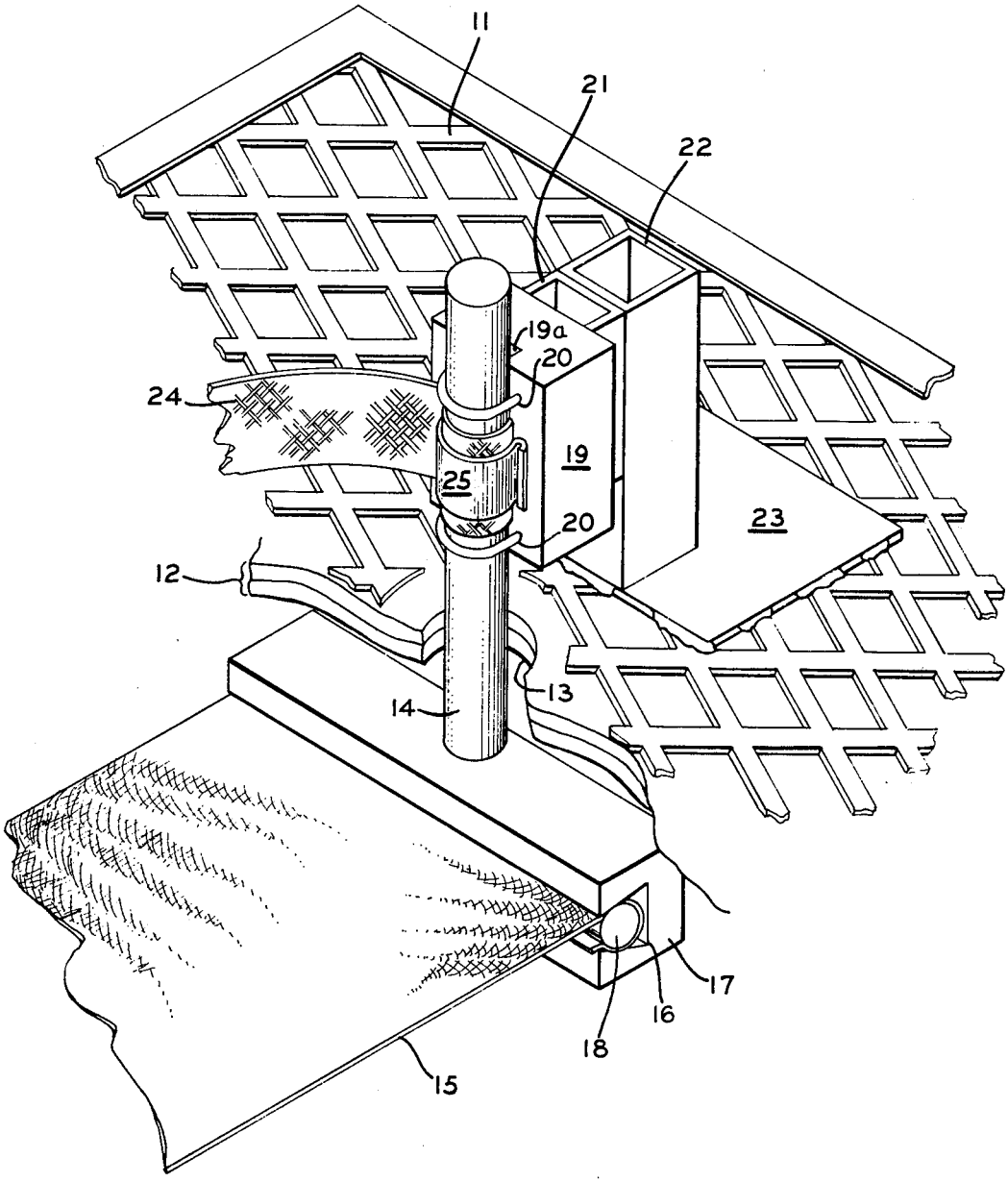
FIG. 2 is a drawing in greater detail of the support element and the electrical connection thereto.

Turning to FIG. 2 there is shown in greater detail the physical and electrical features of the novel support element of this invention. The electric heating unit 15 made of a flexible conductive material and preferably for high vacuum or reducing atmosphere furnaces made of graphite cloth is shown secured in a slot 16 transversely located in a bar 17. Specifically the graphite heater cloth 15 is looped about a rod or mandrel 18 located within the transverse slot 16 in bar 17. Tension in the graphite cloth 15 tends to move the mandrel 18 toward the entrance of the slot 16. Since the mandrel 18 has a cross-sectional dimension greater than the width of the entrance of slot 16 the mandrel 18 compresses the graphite 15 between itself and the inner surfaces of the slot 16 producing a strong mechanical locking arrangement to secure the graphite cloth 15 to the bar 17 yet a locking arrangement that can be readily and easily released such for example by forcing the mandrel 18 longitudinally out of the slot 16. This may be most readily accomplished by manually pinching the cloth 15 about the mandrel 18 and forcing the cloth 15 into the slot 16. This reduces the forces normally existing between the slot 16, the cloth 15 and the mandrel 18 allowing the mandrel to be moved more easily in a longitudinal direction in the slot 16. As shown, the end of the electric heating unit 15 extends slightly out of the transverse slot 16.

The bar 17 is formed of an electrically conductive material suitable for use in high temperature, high vacuum installations and is preferably made of graphite. The mandrel 18 may be made of any material that will satisfactorily withstand the high temperatures generally encountered in a high temperature high vacuum furnace. In practice it has been determined that a mandrel constructed of graphite provides a satisfactory holding action for the graphite cloth 15.

Attached to the bar 17, as by a threaded hole 17*a,* is the support rod 14 which also is formed of an electrically conductive material capable of withstanding a high temperature such, for example, as graphite. The support rod 14 is physically secured to the cage 11 to provide the mechanical positioning and support for the electric heating unit 15. In order to secure the rod 14 to the cage 11 and to provide the necessary electrical insulation the support rod 14 is secured to a block 19 of insulating material by a pair of U-bolts 20 that surround the rod 14 and pass through holes located in insulating block 19 to draw the rod 14 firmly against the block 19. The insulating block 19 is in turn attached to steel tube 21 by a pair of screws, not shown, passing through block 19 and threaded into steel tube 21. The screw heads are recessed into a channel 19*a* in insulating block 19 to provide the necessary electrical isolation from rod 14. Tube 21 is welded to a steel tube 22 which is in turn secured as by welding to a plate 23 that is welded to the expanded metal cage 11.

To provide the electrical connection to the electric heating unit 15 a conductive braid 24 is secured in intimate conducting relationship to support rod 14 by means of a spring clamp 25. The manner in which the braid 24 may be connected to a souce of electric power to produce the flow of heating current in the heating units 15 is well known to those skilled in the art and has therefore not been shown.

Figure 3A:
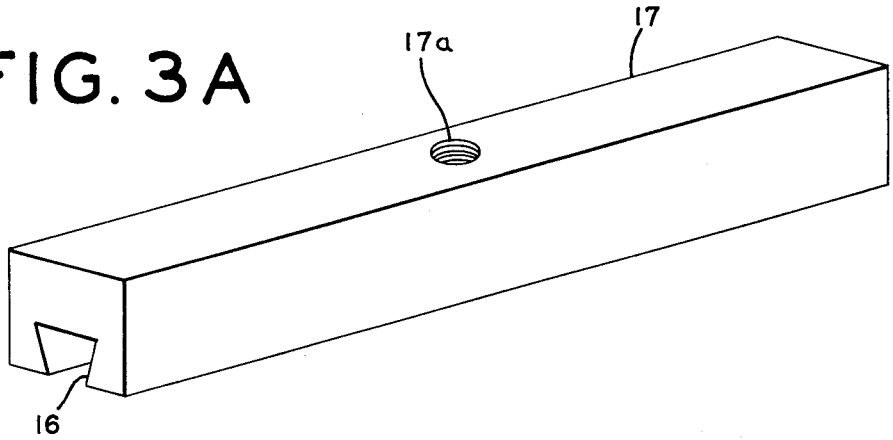
FIGS. 3A and 3B show the structural features of the support element for supporting a center portion of the heating unit and an end portion of the heating unit respectively.
Figure 3B:
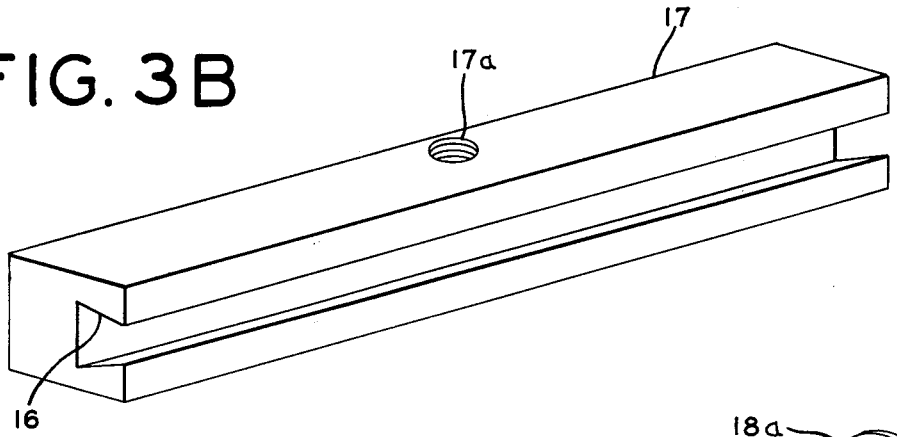
Figure 4:
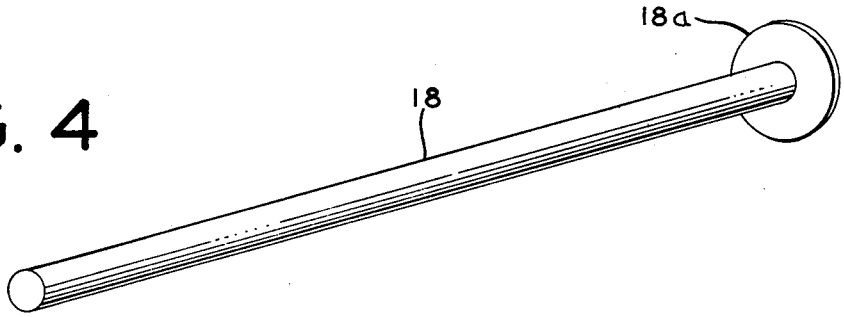
FIG. 4 shows a variation of the structure of one part of the supporting element.

FIG. 3A discloses the bar 17 that is associated with and used for support of the end of the heating unit 15. FIG. 3B discloses the bar 17 that would be used to support the heating unit 15 at a point intermediate its ends. It is to be noted that each of the bars shown in FIGS. 3A and 3B are provided with a tapped hole 17*a* into which the threaded extremity of support rod 14 is assembled to provide mechanical support and electrical connection to the heater 15.

The heater support element of this invention greatly simplifies the process of installing heating units into a furnace. In practice the new heating unit 15 of graphite cloth is placed across the face of the bar 17 in which is located the longitudinal slot 16. A loop of the graphite cloth 15 is formed within the slot 16. This may be accomplished by forming a bight in the graphite cloth 15 and inserting the bight through the entrance of the longitudinal slot 16 or by using a blunt straight edge to force the loop of graphite cloth 15 into the longitudinal slot 16. With the loop of graphite cloth 15 located within the longitudinal slot 16 the mandrel 18 is slid into the loop of cloth 15 within the slot 16. Tension in the graphite cloth may be adjusted by working the cloth 15 around the mandrel 18. To this end when the mandrel 18 is of circular cross-section a knob or handle 18*a* may be secured to one end of the mandrel 18 to permit the installer to rotate the mandrel 18 more easily to work the cloth 15 through the slot 16 for adjustment of the tension. The knob 18*a* also insures that the mandrel cannot inadvertently slip out of the vertically disposed slots 16 during expansion and contraction of the various furnace parts produced by heating and cooling of the furnace. When installing cloth 15 in end supports 17 the excess cloth 15 may be trimmed off when the installation is complete.

It is to be understood that while a particular shape of slot 16 and mandrel 18 has been shown that the invention is not limited in any way to the details of the slot or mandrel other than as claimed in the appended claims.

What is claimed is:

1. In an electric furnace having an electric heater formed of aflexible material, an improved electrical connecting and supporting element for said heater comprising a bar of electrically conductive material having in a face thereof a longitudinal slot parallel with the longitudinal axis of said bar with the width of its entrance of lesser dimension than the width of the inner portion of said slot to receive within said slot a loop of said flexible electric heater, and a mandrel having a cross-sectional dimension greater than said width of said entrance and less than said width of said inner portion of said slot inserted within said loop within said slot whereby said flexible material is mechanically secured to said bar of electrically conductive material and provides an electrical connection between said bar and said heater.

2. The connecting element of claim 1 in which said slot is dovetail shaped.

3. The connecting element of claim 1 in which said mandrel is cylindrical in shape.

4. The connecting element of claim 1 in which one end of said mandrel is provided with an enlarged portion.

5. The connecting element of claim 1 including means for securing said bar in fixed spatial relation in said furnace.

6. The connecting element of claim 4 in which said securing means includes a cylindrical extension of electrically conductive material attached to said bar to support said bar and to serve as the electrical connector for said heater.

7. The combination of claim 5 in which said furnace includes a heat insulated heating chamber with said cylindrical extensions of said securing means extending through openings in said insulated heating chamber.

8. The combination of claim 6 in which said heat insulated heating chamber is surrounded by a rigid metallic cage, and electrically insulating means for securing said electrically conductive cylindrical extensions in fixed spatial relation to said cage.

* * * * *